US006945253B2

(12) United States Patent
Michel et al.

(10) Patent No.: US 6,945,253 B2
(45) Date of Patent: Sep. 20, 2005

(54) COSMETIC APPLICATOR

(75) Inventors: Richard Michel, London (GB); Andrew Michel, London (GB)

(73) Assignee: Caressa Kahn Limited, Hertfordshire (GB)

( * ) Notice: Subject to any disclaimer, the term of this patent is extended or adjusted under 35 U.S.C. 154(b) by 0 days.

(21) Appl. No.: 10/445,298

(22) Filed: May 27, 2003

(65) Prior Publication Data

US 2004/0011377 A1 Jan. 22, 2004

Related U.S. Application Data

(63) Continuation-in-part of application No. 10/198,055, filed on Jul. 19, 2002.

(30) Foreign Application Priority Data

May 27, 2002 (GB) ..... 0212155

(51) Int. Cl.[7] ..... A45D 40/26
(52) U.S. Cl. ..... 132/200; 132/320
(58) Field of Search ..... 132/320, 293, 132/200; 401/132, 133; 206/581, 572, 484, 823, 530, 525.1; 15/29.14

(56) References Cited

U.S. PATENT DOCUMENTS

| | | | | |
|---|---|---|---|---|
| 3,297,032 A | * | 1/1967 | Antonik | 604/306 |
| 3,635,567 A | | 1/1972 | Richardson, Jr. | 401/132 |
| 4,899,739 A | * | 2/1990 | Konishi | 604/306 |
| 5,639,532 A | | 6/1997 | Wells | 428/95 |
| 6,315,480 B1 | | 11/2001 | Martel et al. | 401/132 |

FOREIGN PATENT DOCUMENTS

| | | |
|---|---|---|
| EP | 0963715 A2 | 12/1999 |
| GB | 1276786 | 6/1972 |
| GB | 2372938 A | 9/2002 |

* cited by examiner

*Primary Examiner*—Todd E. Manahan
(74) *Attorney, Agent, or Firm*—Jacobson Holman PLLC

(57) ABSTRACT

A single-use cosmetic applicator 1 has an applicator body 2 with a front surface 3 and a rear surface 4. The cosmetic applicator 1 has a sealed substantially impermeable membrane containing a pre-determined quantity of a cosmetic product 5 attached to an inner surface of a substantially impermeable cover, so that the membrane lies between the cover 7 and the applicator body 2.

6 Claims, 1 Drawing Sheet

COSMETIC APPLICATOR

This is a Continuation-in-Part of U.S. Ser. No. 10/198,055 filed Jul. 19, 2002.

BACKGROUND OF THE INVENTION

1. Field of the Invention

The present invention relates to a single-use cosmetic applicator.

2. Description of the Prior Art

Single-use cosmetic applicators, which are supplied with a pre-determined quantity of a cosmetic product, such as make-up, moisturiser, cleanser etc., are known. Such single-use applicators are manufactured from a disposable material substantially fully infused with the appropriate cosmetic product, for example, nail varnish remover, and sealed in a container in multiples or singularly. This results in relatively costly manufacture, since a greater quantity of cosmetic product is applied to the sheet of material than is required. In addition, it is inconvenient for the user if substantially all of the applicator is infused with the cosmetic product, since the user will need to hold the applicator when removed from its packaging. The part of the applicator held by the user's hand will thus transfer cosmetic product to the user's hand, which is obviously undesirable. This is particularly disadvantageous when the product is applied in an area without washing facilities, for example, at sales counters.

Furthermore, some users prefer to apply some of the cosmetic product to their skin with the hands and merely use the applicator to distribute the product evenly on the skin. This would not be possible if the entire surface of the applicator were infused with the cosmetic product, since application of the applicator to the skin would result in transfer of further product to the skin, thus resulting in uneven application of the cosmetic product. In addition, it would be very difficult to control the amount of cosmetic product transferred from the applicator to the skin, increasing the chances of excessive application of the product.

SUMMARY OF THE INVENTION

It is an object of the invention to overcome the above disadvantages.

The invention provides a single-use cosmetic applicator.

In a preferred embodiment the sealed substantially impermeable membrane/bubble is attached to the inner surface of the removable substantially impermeable cover by adhesion. Alternatively, the substantially impermeable membrane/bubble is attached to the inner surface of the removable cover by lamination.

The removable cover is preferably removable from the front surface by peeling to permit use of the cosmetic product.

In a further preferred embodiment, the cosmetic applicator has a substantially impermeable cover over substantially all of the front surface to protect it from contamination before use.

In a yet further preferred embodiment, a substantially impermeable backing layer is provided on the rear surface. The backing layer serves to protect the applicator and facilitate gripping of the applicator by the user.

The substantially impermeable membrane/bubble is preferably arranged substantially centrally of the applicator to aid distribution of the product on the applicator, in use.

The invention also provides a method of manufacturing a single-use cosmetic applicator.

BRIEF DESCRIPTION OF THE DRAWINGS

Embodiments of the invention will now be described with reference to the accompanying drawing FIG. 1 showing a cross-section view of a single-use applicator according to the invention.

DESCRIPTION OF THE PREFERRED EMBODIMENT

Figure 1:
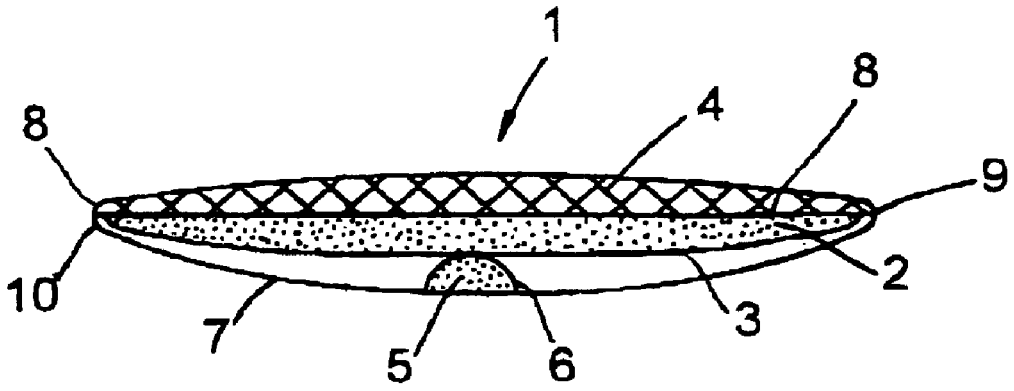

In the drawing, a cosmetic applicator 1 has an applicator body 2 with a front surface 3 for application of the product and a rear surface 4. A pre-determined quantity of a cosmetic product 5, such as moisturiser, cleanser, toner, make-up, tanning mousse etc., is located substantially centrally of the applicator 1 between a substantially impermeable membrane 6 and an inner surface of a removable, substantially impermeable cover 7 to which the membrane 6 is attached. This prevents migration of the cosmetic product 5 prior to use. The cosmetic product 5 can be released by the user by bursting the impermeable membrane 6.

The substantially impermeable cover 7 is arranged across substantially all of the surface 3 to protect it from contaminants such as dust and moisture prior to use of the applicator 1. The cover 7 may be made of polyethylene, or of any other suitable material. The membrane 6 is attached to the cover 7 by adhesion, lamination or any other suitable method.

The applicator body 2 may be made of a polyurethane foam. The grade of the polyurethane foam is selected according to the cosmetic product 5 used. Polyurethane foam could be replaced by any other suitable material, such as polyester non-woven material, nitrile butyl rubber sponge or synthetic rubber sponge.

The rear surface 4, by which the user holds the applicator 1, is backed with a backing layer 8. The backing layer 8 serves to protect the applicator body 2, the user's hands from cosmetic product 5 and also to facilitate gripping of the applicator 1 by the user. The backing layer 8 may also be provided with a handle (not shown) to improve gripping of the applicator 1. The backing layer 8 may be attached to the surface 4 by means of a heat-seal or adhesive to prevent its removal.

In the embodiment shown in the drawing a peripheral edge 9 of the backing layer 8 is aligned with a peripheral edge 10 of the cover 7, to which it is attached by means of adhesive or a heat seal. The cover 7 is thus removably attached to the backing layer 8, but not to the surface 3, so that it can be peeled away relatively easily when the applicator 1 is required for use. In an alternative embodiment the cover 7 is attached at its periphery directly to the surface 3.

In use, the user first removes the cover 7 by peeling it away from either the front surface 3 or the backing layer 8. The user bursts the membrane 6 by applying thumb/finger pressure to the membrane 6 to release the cosmetic product 5. The membrane 6 can be burst just before the cover 7 is removed or after the cover 7 is removed. The cosmetic product 5 can be applied to the skin using the fingertips or by rubbing the surface 3 across the skin. If the cosmetic product 5 is applied using the fingertips, the surface 3 not covered by the cosmetic product can be used to distribute the cosmetic product 5 evenly on the skin.

The applicator 1 can be manufactured using a variety of methods. In one such method, a membrane 6 containing a pre-determined quantity of the cosmetic product 5 is applied to a substantially impermeable cover 7 which is applied to a sheet of material from which the applicator body 2 is to be cut. The applicator body 2 is cut from the sheet of material.

These steps are carried out substantially simultaneously. It is, of course, possible to carry out the steps of applying the membrane 6 to the cover 7 and the cover 7 to the sheet of material sequentially. Similarly, the cutting step can be carried out at a different stage to the application of the membrane 6 to the cover 7 and the cover 7 to the sheet of material.

The cover 7 and the backing layer 8 are attached to the applicator 1 prior to or after cutting of the applicator body 2.

It will, of course, be appreciated that variations may be made to the embodiments of the invention described above. For example, the cover 7 could be provided with perforations around its periphery to facilitate removal from the applicator 1. Alternatively, if means are not be provided for facilitating removal of the cover 7, it could be removed with scissors or a knife.

The membrane 6 could be replaced by a bubble pack so that the cosmetic product is wholly contained with the bubble pack. In this case, the bubble pack would be attached to the cover 7.

The backing layer 8 could be omitted. Only a part of the cover 7 need be substantially impermeable, i.e. only the part of the cover surrounding the cosmetic. Although the cover 7 covers substantially all of the front surface, it is possible to include a cover 7 which only covers an area surrounding the membrane 6. In such a case, the applicator 1 would be stored in a bag or box to protect the front surface from contamination. Similarly, if the membrane 6 is replaced by a bubble pack so that the cosmetic product is wholly contained within the bubble, pack and does not contact the inner surface of the cover 7 prior to use of the applicator, the cover 7 does not need to be made of a substantially impermeable material.

Although the membrane 6 is located substantially centrally of the applicator 1, it could be located on any portion of the front surface 3. However, a substantially central location improves distribution of the product around the front surface during use, if required.

Although the applicator 1 described above is for use with products such as make-up, moisturiser etc. it could also be used with medicinal products such as ointments, antiseptic fluids etc. The terms "cosmetic product" and "cosmetic applicator" should be construed accordingly.

The cover 7 and/or backing layer 8 may carry printed matter, such as instructions for use, trade marks and details of product ingredients.

It will be seen that the embodiments of the applicator 1 described above will avoid unnecessary waste of the cosmetic product 5 and also leave the majority of the front surface 3 free from contamination by the cosmetic product 5 before the product is used.

What is claimed is:

1. A method of manufacturing a single-use cosmetic applicator including the steps of applying a substantially impermeable membrane carrying a pre-determined quantity of a cosmetic product to a removable cover with a substantially impermeable portion, applying the removable cover to a sheet of material from which an applicator is to be cut, and cutting the applicator from the sheet of material.

2. The method as claimed in claim 1, wherein the steps are carried out substantially simultaneously.

3. The method as claimed in claim 1, further comprising the step of applying a substantially impermeable backing layer to a rear side of the cosmetic applicator.

4. A method of manufacturing a single-use cosmetic applicator including the steps of applying a substantially impermeable bubble containing a pre-determined quantity of a cosmetic product to a removable cover, applying the removable cover to a sheet of material from which an applicator is to be cut, and cutting the applicator from the sheet of material.

5. The method as claimed in claim 4, wherein the steps are carried out substantially simultaneously.

6. The method as claimed in claim 4, further comprising the step of applying a substantially impermeable backing layer to a rear side of the cosmetic applicator.

* * * * *